US009248567B2

(12) United States Patent
Harris

(10) Patent No.: US 9,248,567 B2
(45) Date of Patent: Feb. 2, 2016

(54) RETRIEVAL SYSTEM FOR GOLF CLUBS AND BALLS

(71) Applicant: Terry Harris, Cordova, TN (US)

(72) Inventor: Terry Harris, Cordova, TN (US)

( * ) Notice: Subject to any disclaimer, the term of this patent is extended or adjusted under 35 U.S.C. 154(b) by 0 days.

(21) Appl. No.: 14/156,438

(22) Filed: Jan. 15, 2014

(65) Prior Publication Data

US 2014/0125078 A1 May 8, 2014

Related U.S. Application Data

(63) Continuation-in-part of application No. 13/850,303, filed on Mar. 26, 2013, now Pat. No. 9,114,288, which is a continuation of application No. 13/111,162, filed on May 19, 2011, now Pat. No. 8,424,943.

(51) Int. Cl.

| | |
|---|---|
| ***A63B 47/02*** | (2006.01) |
| ***A63B 57/00*** | (2015.01) |
| ***B25J 1/04*** | (2006.01) |
| *A63B 53/14* | (2015.01) |

(52) U.S. Cl.

CPC . *B25J 1/04* (2013.01); *A63B 47/02* (2013.01); *A63B 57/00* (2013.01); *A63B 53/14* (2013.01); *A63B 2209/08* (2013.01)

(58) Field of Classification Search

CPC .... A63B 47/02; A63B 57/00; A63B 2209/08; A63B 53/14; B25J 1/04

USPC ..... 294/19.2, 65.5, 190; 473/285, 286; 411/387.7, 387.8

See application file for complete search history.

(56) References Cited

U.S. PATENT DOCUMENTS

| | | | | |
|---|---|---|---|---|
| 2,178,872 | A | 11/1939 | Engstrom | |
| 2,732,243 | A | 1/1956 | Johnson | |
| 2,979,335 | A | 4/1961 | Pruitt | |
| 4,017,082 | A | 4/1977 | Channing et al. | |
| 5,516,248 | A | 5/1996 | DeHaitre | |
| 5,690,558 | A * | 11/1997 | Huber | 473/285 |
| 5,795,242 | A | 8/1998 | Ree | |
| 6,142,719 | A | 11/2000 | Daubinger | |
| 6,899,635 | B2 | 5/2005 | Nadratowski et al. | |
| 7,390,268 | B2 * | 6/2008 | Merriman | 473/286 |
| 7,857,707 | B2 | 12/2010 | Beppu | |
| 8,424,943 | B2 * | 4/2013 | Harris | 294/190 |
| 2002/0008393 | A1 * | 1/2002 | Nadratowski et al. | 294/19.2 |
| 2003/0083142 | A1 * | 5/2003 | Nam | 473/286 |
| 2006/0264267 | A1 | 11/2006 | Fox | |

(Continued)

FOREIGN PATENT DOCUMENTS

GB 2366832 A 3/2002

*Primary Examiner* — Dean Kramer

(74) *Attorney, Agent, or Firm* — Martino Patent Law at the Law Offices of Sepehr Daghighian

(57) ABSTRACT

A retrieval device for golf clubs and golf balls includes a magnet, a ball retrieval implement, and a helical thread fixed relative to the magnet. The helical thread is screwed onto a proximal end of a grip. The golf club can be used by a golfer to retrieve a laying golf club or ball already on a playing surface without the need for the golfer to bend over or down. The helical thread may include a pointed distal end and a cutting slot or a drill distal end. A body may surround the magnet, where the body includes a base and a top. The top may include an elastomeric material such as rubber. A ball retrieval implement is fixed to the proximal end of the device, such that the device allows a golfer to pick up a ball laying on the ground without the need to bend over or down.

19 Claims, 12 Drawing Sheets

(56) References Cited

U.S. PATENT DOCUMENTS

| | | | | |
|---|---|---|---|---|
| 2007/0049396 | A1 | 3/2007 | Scheibe | |
| 2007/0243945 | A1 | 10/2007 | Hoium et al. | |
| 2007/0298900 | A1 | 12/2007 | Johnson | |
| 2008/0261714 | A1* | 10/2008 | Bae | 473/286 |
| 2010/0105498 | A1 | 4/2010 | Johnson | |
| 2011/0053701 | A1* | 3/2011 | Eddings | 473/286 |

* cited by examiner

RETRIEVAL SYSTEM FOR GOLF CLUBS AND BALLS

CROSS-REFERENCE TO RELATED APPLICATIONS

This application is a continuation-in-part to application Ser. No. 13/850,303 filed on Mar. 26, 2013, which itself was a continuation of application Ser. No. 13/111,162 filed on May 19, 2011 which is now U.S. Pat. No. 8,424,943.

DESCRIPTION

1. Field of the Invention

The present invention generally relates to golf. More particularly, the present invention relates to a retrieval system for golf clubs and golf balls.

2. Background of the Invention

Golf is a precision club-and-ball sport, in which competing players (golfers), using many types of clubs, attempt to hit balls into each hole on a golf course while making the fewest number of strokes. Golf is one of the few ball games that does not require a standardized playing area. Instead, the game is played on golf "courses," each of which features a unique design of 9 or 18 holes. Golf is defined, in the rules of golf, as "playing a ball with a club from the teeing ground into the hole by a stroke or successive strokes in accordance with the Rules." Golf competition is generally played for the lowest number of strokes by an individual, known simply as stroke play, or the lowest score on the most individual holes during a complete round by an individual or team, known as match play.

The origin of golf is unclear and open to debate. Some historians trace the sport back to the Roman game of paganica, in which participants used a bent stick to hit a stuffed leather ball. One theory asserts that paganica spread throughout Europe as the Romans conquered most of the continent, during the first century B.C., and eventually evolved into the modern game. Others cite chuiwan ("chui" means striking and "wan" means small ball) as the progenitor, a Chinese game played between the eighth and 14th centuries. A Ming Dynasty scroll dating back to 1368 entitled "The Autumn Banquet", shows a member of the Chinese Imperial court swinging what appears to be a golf club at a small ball with the aim of sinking it into a hole. The game is thought to have been introduced into Europe during the Middle Ages. Another early game that resembled modern golf was known as cambuca in England and chambot in France. This game was, in turn, exported to the Germany and England (where it was called pall-mall, pronounced "pell mell"). Some observers, however, believe that golf descended from the Persian game, chaugan. In addition, kolven (a game involving a ball and curved bats) was played annually in Loenen, Netherlands, beginning in 1297, to commemorate the capture of the assassin of Floris V, a year earlier. No matter where golf originated from, the modern game of golf came from Scotland, where the first written record of golf is James II's banning of the game in 1457.

Since the beginnings of golf, the sport has spread throughout the world. Today, millions of people play golf every year along a similar set of rules. The initial stroke on a hole is a long-distance shot intended to move the ball a great distance down the fairway, as this shot is commonly called a "drive." Shorter holes generally are initiated with "shorter" clubs. Once the ball comes to rest, the golfer strikes it again as many times as necessary using shots that are variously known as a lay-up, an approach, a "pitch," or a chip, until the ball reaches the green, where he or she then putts the ball into the hole (commonly called "sinking the putt"). The goal of getting the ball into the hole ("holing" the ball) in as few strokes as possible may be impeded by obstacles such as areas of long grass called rough (usually found alongside fairways) which both slows any ball that contacts it and makes it harder to advance a ball that has stopped on it, bunkers ("sand traps"), and water hazards. In most forms of gameplay, each player plays his or her ball until it is holed.

Golfers typically use a set of several clubs as they make their way around a course. When playing golf, it is very common for a club to placed upon the ground for a variety of reasons. A club may be placed on the ground to mark a ball or simply laid down when choosing between clubs. A club may fall to the ground mistakenly or even be thrown down in frustration. In either case, the club must be picked up. It can become tiresome to be repeatedly bending over to pick up a club. Also, many golfers are of an older age making it more difficult to bend down to pick up objects. Balance is difficult and a person may stumble and fall over. Also, joints don't bend as well as they did when one was younger. Accordingly, there is a need for a way to pick up a club and various other metallic objects without the need to bend over, which can be utilized on the golf course. The Inventor accordingly filed and was awarded U.S. Pat. No. 8,424,943 for a Magnetic Retrieval System for a Golf Club, which addressed many of these problems.

Meanwhile, as the game of golf is played, golf balls are spread throughout the course and also need to be picked up by the golfer. As with golf clubs, picking up golf balls can be tiresome and especially burdensome to elderly players whose joints don't bend as well as younger persons. Accordingly, there is also a need for a convenient way for golfers to pick up their golf balls without the need to bend over. While various devices are known in the art for picking up golf balls, none of these devices incorporates a golf club that features a magnetic retrieval system, such as is disclosed by the Inventor's U.S. Pat. No. 8,424,943.

The present invention fulfills these needs and provides other related advantages.

SUMMARY OF THE INVENTION

An exemplary retrieval device for golf balls and golf clubs of the present invention is attachable to a grip of a golf club. The device includes a magnet and a helical thread fixed relative to the magnet. The helical thread is screwed onto a proximal end of the grip of the golf club. The golf club can be used by a golfer to retrieve a laying golf club already on a playing surface without the need for the golfer to bend over or bend down. The device further includes a ball retrieval implement fixed to its proximal end, such that a golfer may retrieve a golf ball from the ground without bending over or bending down. The ball retrieval implement may comprise a friction based ball retrieval implement, a suction based ball retrieval implement, an adhesive based ball retrieval implement, or other such ball retrieval implements.

In an exemplary embodiment, the helical thread includes a pointed distal end. The helical thread may also include a thread-cutting screw type. The thread cutting screw type may include a cutting slot. The cutting slot is for cutting threads when the device is screwed onto the proximal end of the grip of the golf club.

In another exemplary embodiment, the helical thread includes a self-drilling thread type. The self-drilling thread type may include a drill distal end.

In an exemplary embodiment, the magnet may include a rare earth magnet. A body may surround the magnet. The body may comprise an elastomeric material, such as rubber. The body may include a base and a top. The top may include an elastomeric material. The helical thread may comprise a metallic material.

In an exemplary embodiment, the top of the body may further comprise a ball retrieval implement located at the proximal end of the device.

In one exemplary embodiment, the ball retrieval implement comprises a suction based ball retrieval implement. Such a suction based ball retrieval implement comprises an open semi-spherical rubber surface, which approximates the diameter of a standard sized golf ball. When the suction based ball retrieval implement is pressed against the outer surface of a golf ball, a suction grip is created between the implement and the ball. The golfer is, thereby, able, by lifting the golf club, to retrieve the club from the ground.

In another exemplary embodiment, the ball retrieval implement comprises a friction based ball retrieval implement. Such a friction based ball retrieval implement comprises a semi-spherical opening facing outwardly from the distal end of the body of the device. The circumference of the semi-spherical opening is very slightly larger than the circumference of a standard sized golf ball. Such a friction based ball retrieval implement works to pick up balls when the user presses the semi-spherical opening over a golf ball. The implement operates by creating a friction grip between the circumference of the semi-spherical opening and the outer surface of the golf ball. When the club is raised by the golfer, the semi-spherical opening operates to conveniently lift the ball from the ground.

In another exemplary embodiment, the ball retrieval implement comprises an adhesive surface that is adapted to re-attachably adhere to a golf club. Such an adhesive surface, when pressed against a golf ball, creates an adhesive bond between the top of the implement and the ball. As such, a golfer that lifts the golf club is able to retrieve a golf ball from the ground without bending over.

In another exemplary embodiment, the base may include a hex-shaped recess joined to an aperture. The helical thread may include a screw with a hex head. The hex-shaped recess may cooperatively receive the hex head of the screw, such that the screw is securely held and cannot rotate relative to the base. The helical thread of the screw protrudes through the aperture. The device may be screwed manually into the proximal end of the grip of a golf club.

In exemplary embodiments, the helical thread comprises a pointed distal end and a cutting slot. A body may surround the magnet, where a portion of the body comprises an elastomeric material. The top of the body features one or more of the disclosed ball retrieval implements.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
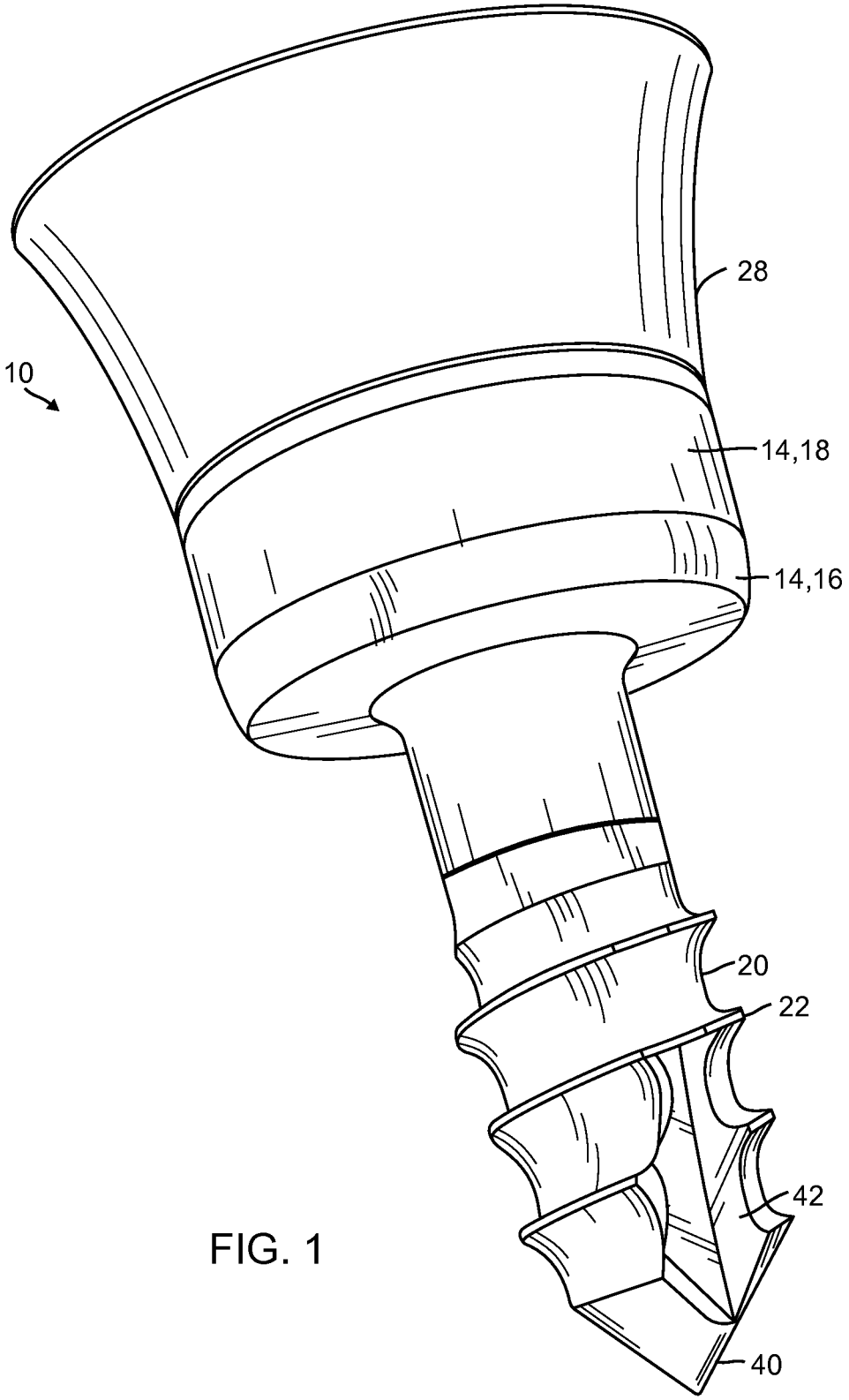
FIG. 1 is a perspective view of an exemplary retrieval device for golf clubs and golf balls embodying the present invention.
Figure 2:
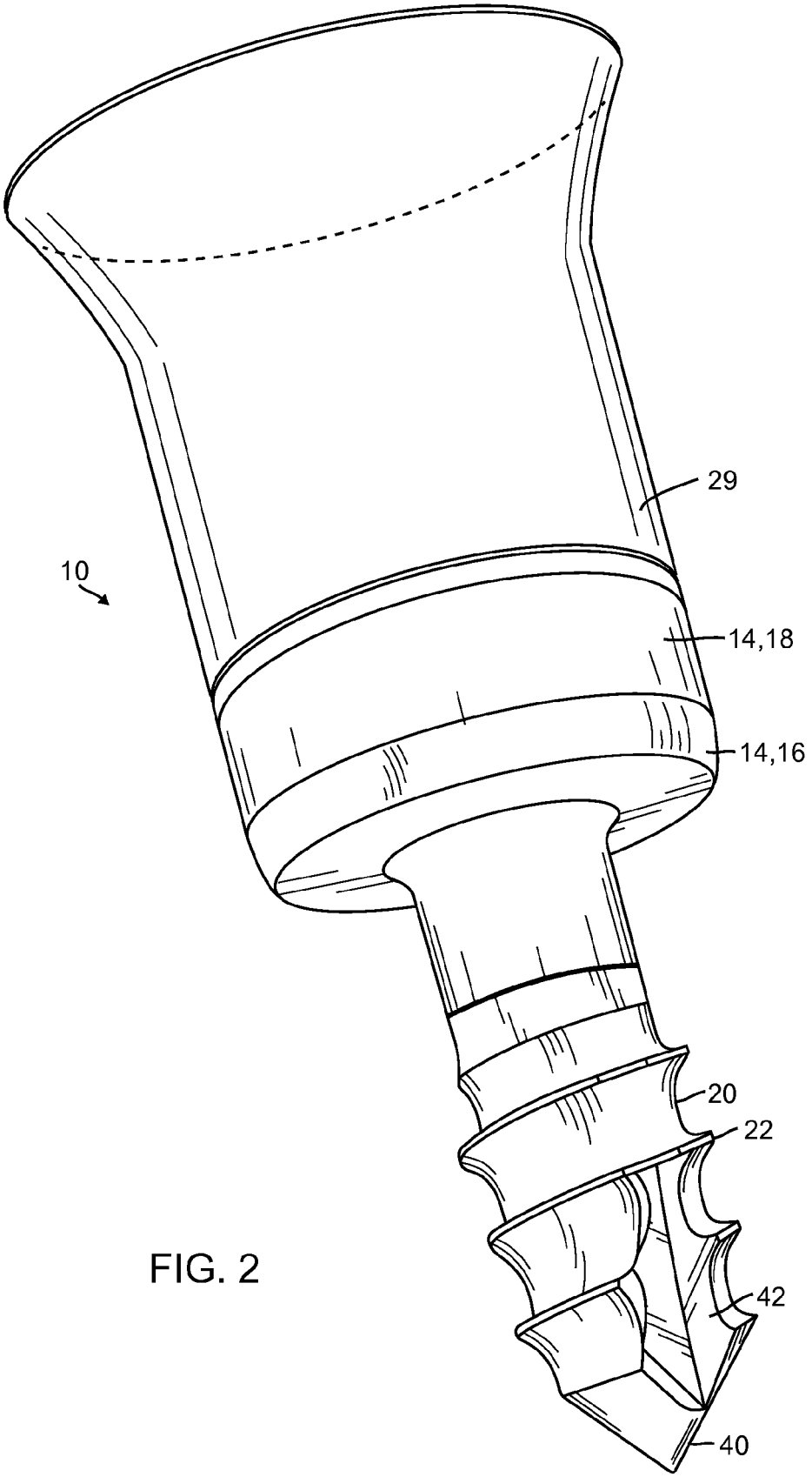
FIG. 2 is a perspective view of another exemplary retrieval device for golf clubs and golf balls embodying the present invention.

FIG. 1 is a perspective view of an exemplary retrieval device for golf clubs and golf balls 10 embodying the present invention. FIG. 2 is an exploded perspective view of the structure of FIG. 1. A magnet 12 is surrounded by a body 14. The magnet 12 may be a variety of magnet types, including a rare earth magnet. Rare earth magnets have extremely strong magnetic attractions despite their small size.

The body 14 may be formed in a multitude of designs and configurations. As shown in FIG. 2, the body 14 may be comprised of a base 16 and a top 18. The base 16 and top 18 cooperatively surround the magnet 12. The base 16 and top 18 may be welded, bonded, adhered or fastened together to encase the magnet 12. Alternatively, the base 16 and top 18 may be formed as a single unit in a molding process.

In an exemplary embodiment, the top 18 may be formed from a variety of elastomeric materials including rubber. The base may be similarly formed of a variety of materials, including plastics, metals composites and various combinations thereof.

A screw 20 is attached to the base 16. The screw 20 includes a helical thread 22. The screw 20 and helical thread 22 may be attached to the base 16 or formed as a single part. The retrieval device for golf clubs and golf balls 10 is then attachable to a grip 24 of a golf club 26. The golf club 26 can be used by a golfer 34 to retrieve a laying golf club 30 already on a playing surface 32 without the need for the golfer to bend over or bend down.

In an exemplary embodiment shown in FIG. 1, the top of the body features a suction-based ball retrieval implement 28, which allows the golfer 34 to retrieve a golf ball 48 from the ground without needing to bend over. In another exemplary embodiment shown in FIG. 2, the top of the body features a friction-based ball retrieval implement 29, which allows the golfer 34 to retrieve a golf ball 48 from the ground without needing to bend over. In an exemplary embodiment shown in FIG. 3, the top of the body features an adhesive-based ball retrieval implement 27, which allows the golfer 34 to retrieve a golf ball 48 from the ground without needing to bend over.

Figure 3:
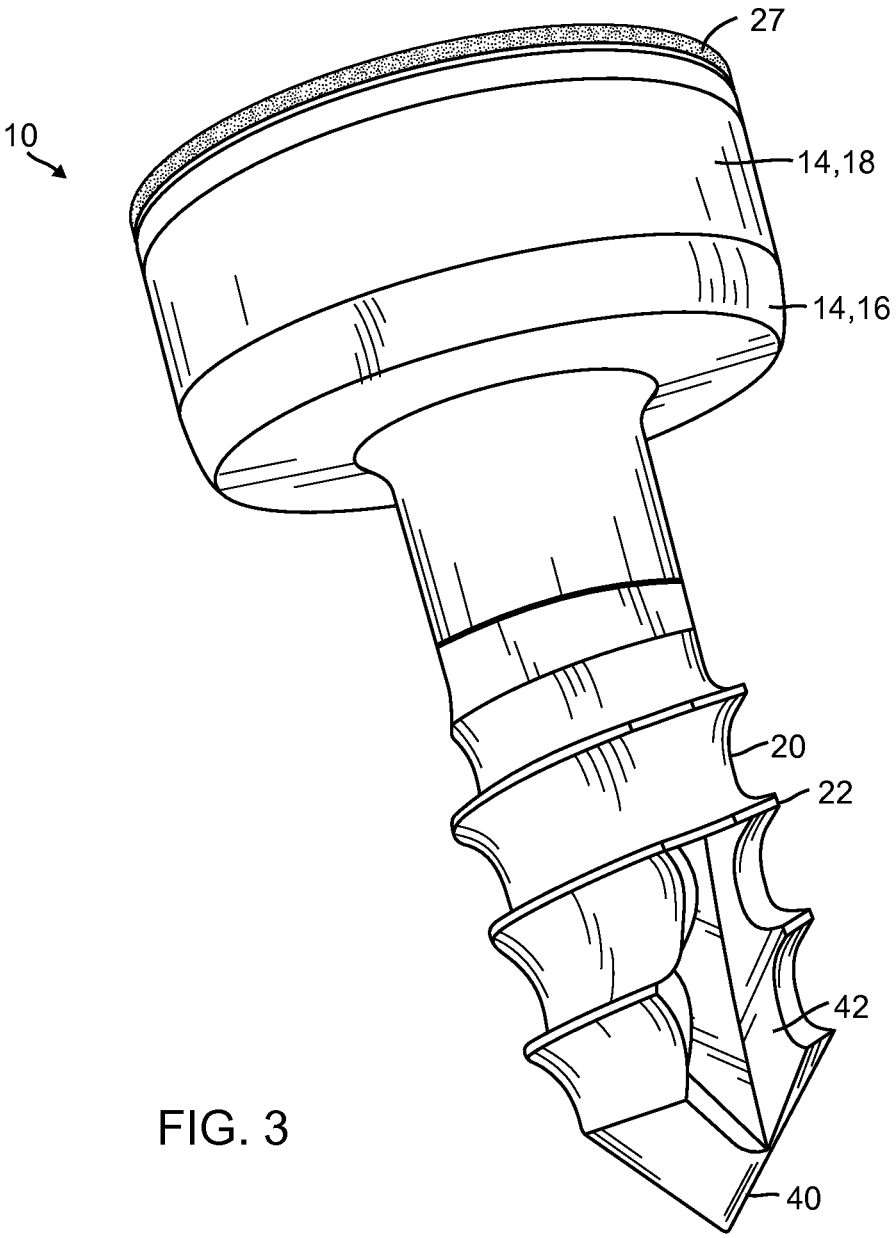
FIG. 3 is a perspective view of another exemplary retrieval device for golf clubs and golf balls embodying the present invention.

The principles of the invention shown in FIGS. 4 to 12 apply to ball retrieval implement variously shown as suction-based ball retrieval implement 28 in FIG. 1, a friction-based ball retrieval implement 29 in FIG. 2, and an adhesive-based ball retrieval implement 27 in FIG. 3. It should be noted that the principles of the invention apply to the suction-based, friction-based, or adhesive-based ball retrieval implements shown in FIG. 1, 2, or 3, respectively, as well as other ball retrieval implements that are currently known in the art.

Figure 4:
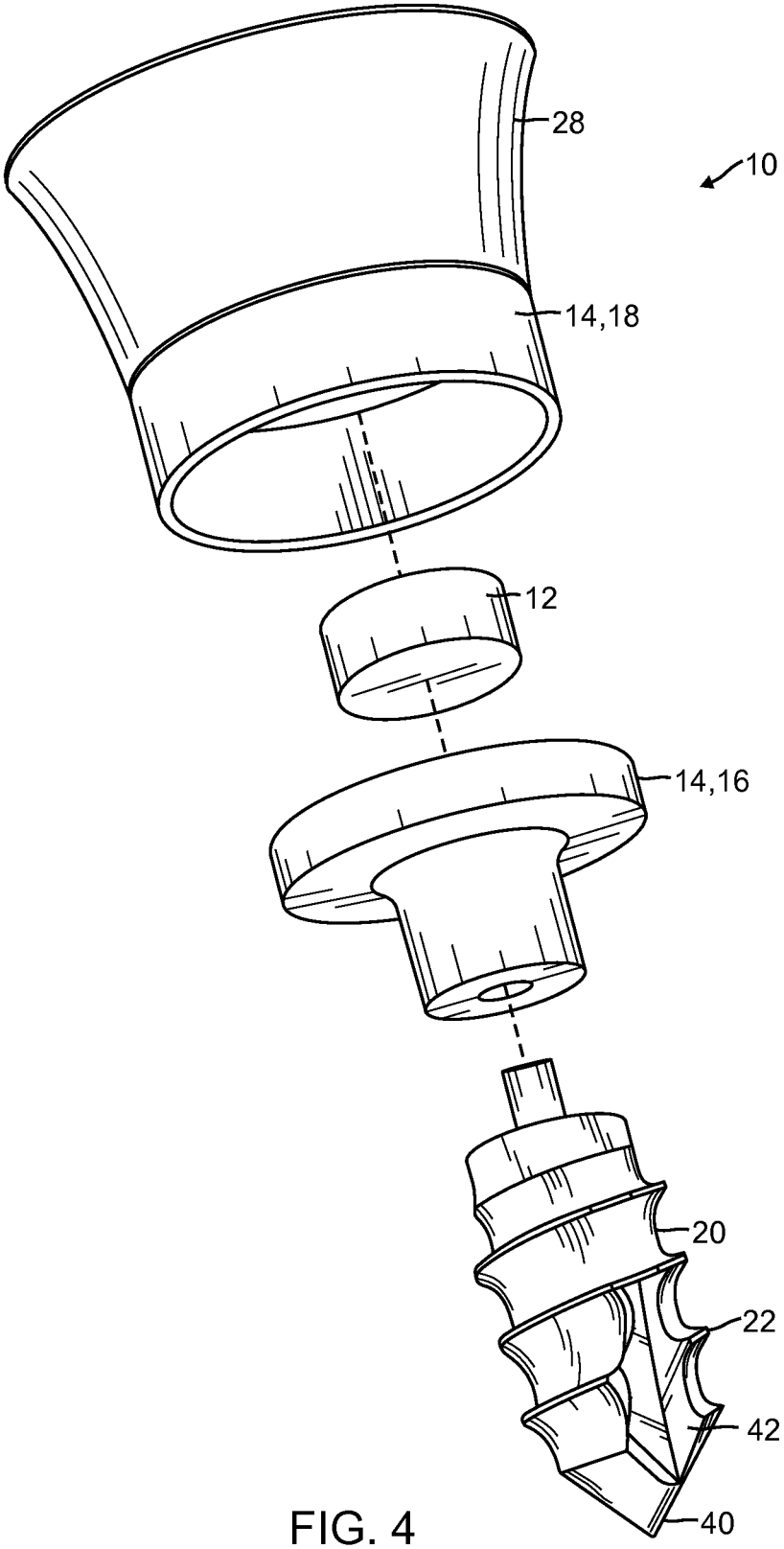
FIG. 4 is an exploded perspective view of the structure of FIG. 1.

FIG. 4 is an exploded perspective view of the structure of FIG. 1.

Figure 5:
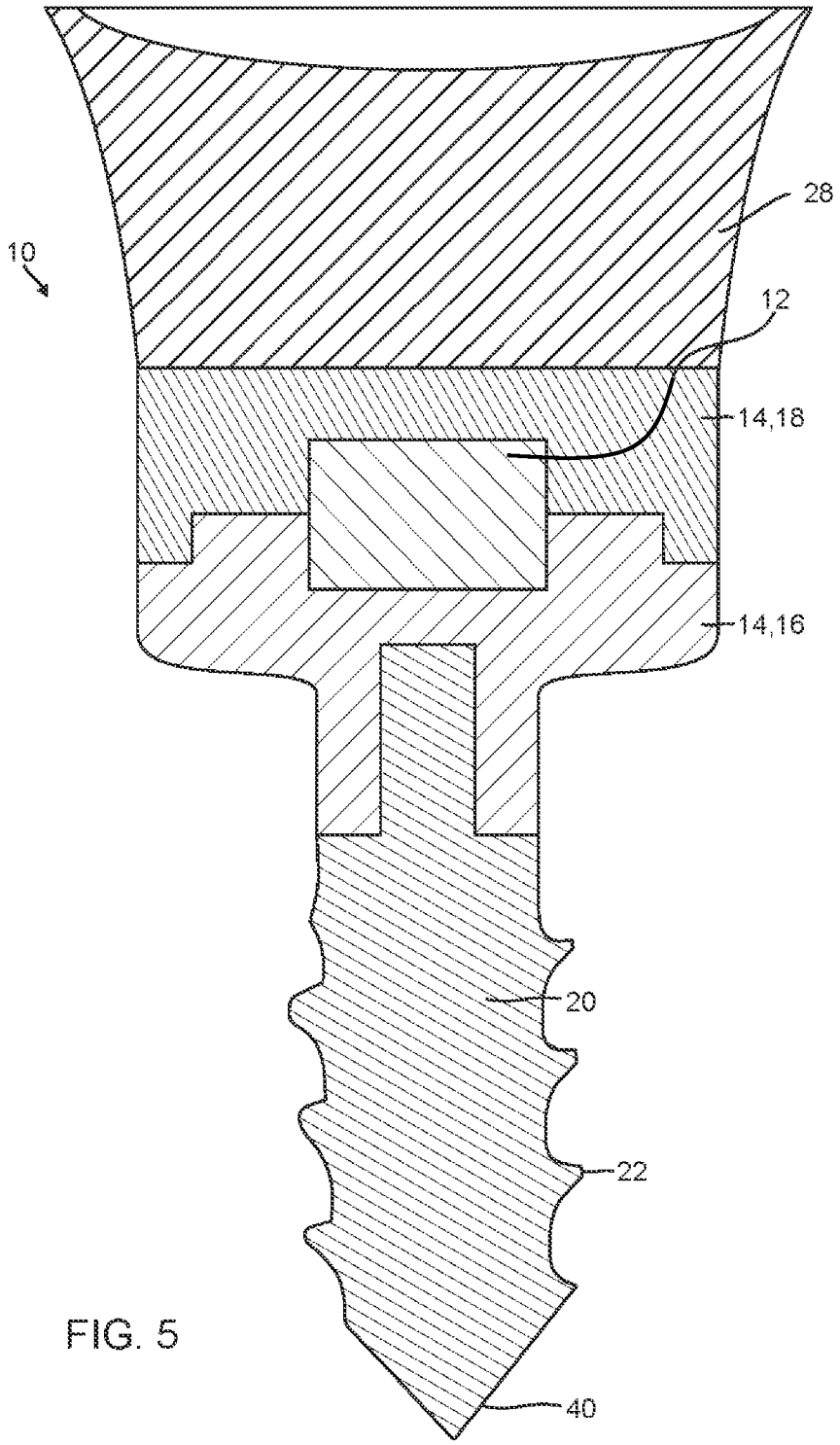
FIG. 5 is a cross-sectional view of the structure of FIG. 1.

FIG. 5 is a cross-sectional view of the structure of FIG. 1, showing how the ball retrieval implement 28 is fixed to the top 18 of the body 14. The ball retrieval implement 28 is fixed in non-movable relation to the body 18 and the threads 20. Also shown is how the top 18 and base 16 cooperate to secure the magnet 12 in place. It will also be understood that the top 18 and implement 28 may be formed from one structure thereby eliminating the need for an extra part in manufacture.

Figure 6:
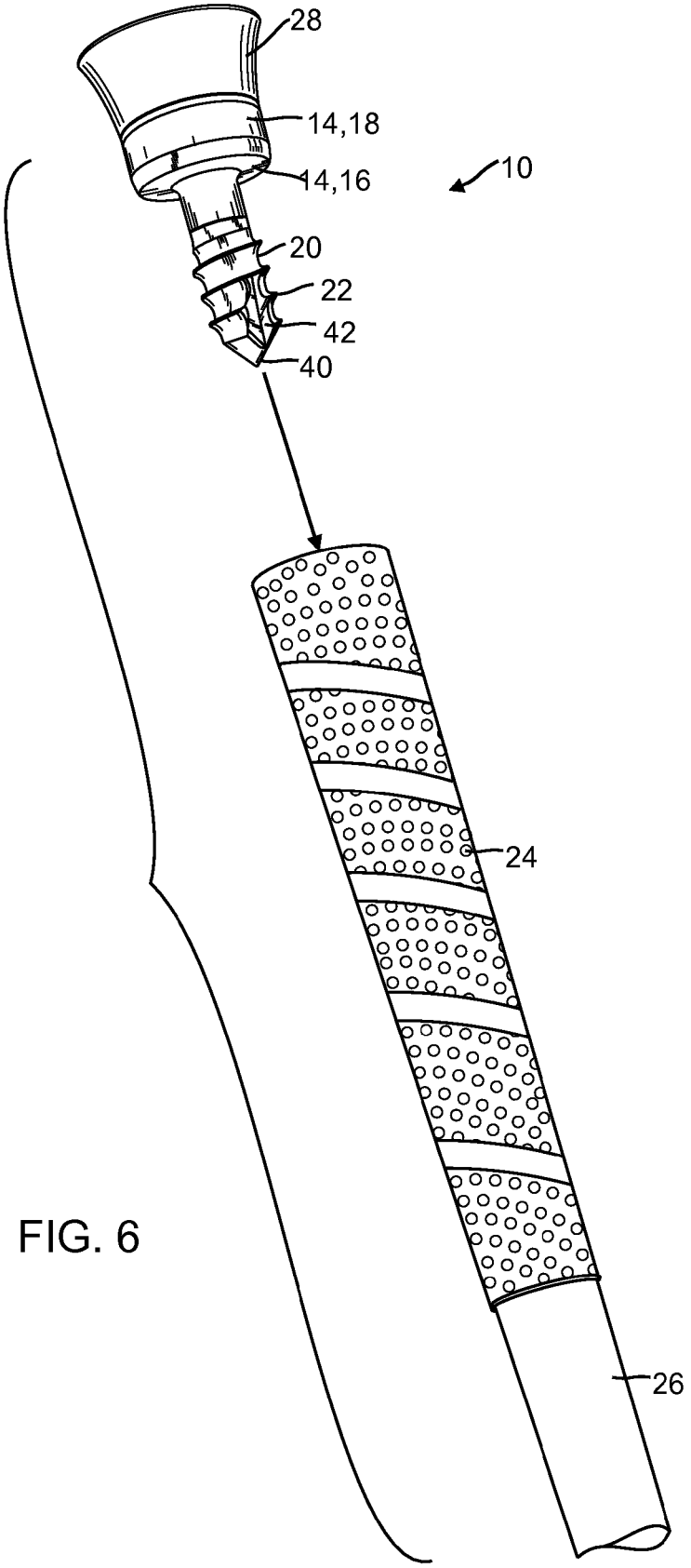
FIG. 6 is a perspective view of the structure of FIG. 1 about to be installed onto a club grip.
Figure 7:
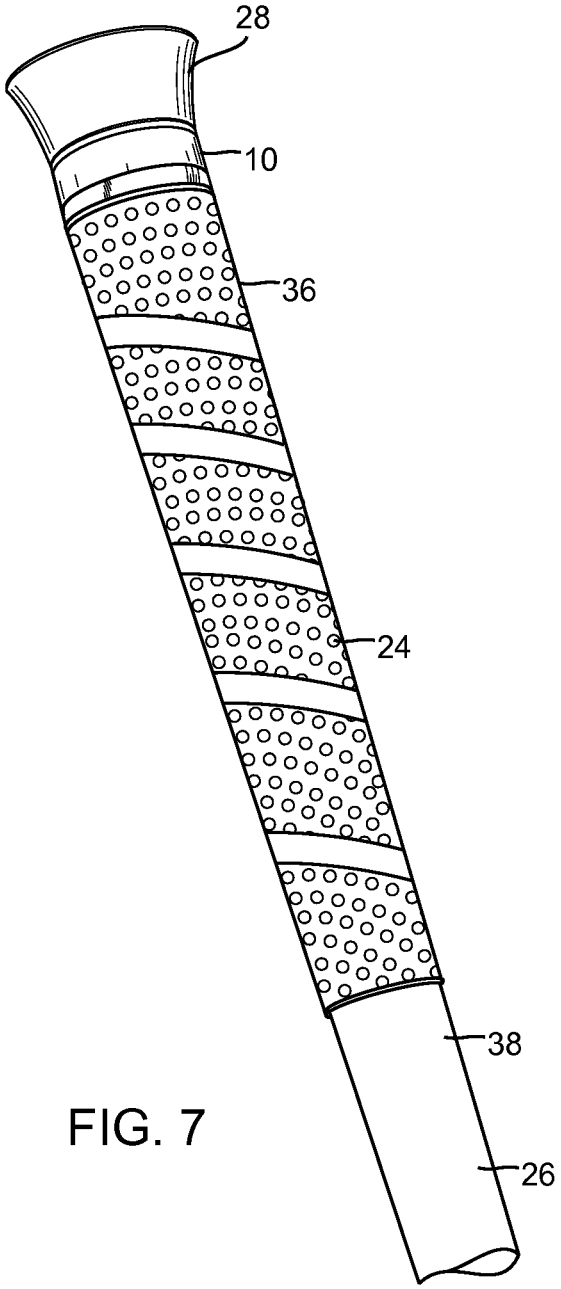
FIG. 7 is a perspective view of the structure of FIG. 1 installed onto a club grip.

FIG. 6 is a perspective view of the structure of FIG. 1 about to be installed onto a grip 24, and FIG. 7 is a perspective view of the structure of FIG. 1 already installed onto the grip 24. The retrieval device for golf clubs and golf balls is simply screwed on the proximal end 36 of the grip 24 by penetrating and attaching to the rubber end of the club. Therefore, the golf club shaft 38, grip 24 and device 10 are all in alignment. It helps for ease of the user that all the parts are locked in non-movable relation to one another. Therefore, when the user twists and applies force to the implement 28 that force is transmitted all the way down in the screw portion such that it penetrates the grip 24 with ease. Therefore, it is advantageous that the body 14, 16, 18 and/or the implement 28 have a substantially outer cylindrical surface such that one can easily grasp it for attachment. It will also be understood that the outer cylindrical surface could have a grooves, knurling or other gripping surfaces or textures applied to help a user grip the outer cylindrical surface. Preferably, the outer cylindrical surface of the body 14 or the body 14 and the implement 28 is at least a quarter inch in height. More preferably this outer cylindrical surface is at least a half inch in height. And even more preferably, the outer cylindrical surface is at least three quarters an inch in height. It is a preferred embodiment that the outer cylindrical surface of the body 14 and the implement 28 are seamlessly attached thereby adding height for a user to grasp as shown in FIG. 5. This means that the outer cylindrical surface is continuous and does not abruptly change diameter when transitioning between the body 18 to the implement 28. Again, the body 18 and implement 28 may be integrally formed as one unit. It is also advantageous if the outer cylindrical surface is the same diameter as the grip of the golf club. In this way, the transition from the grip to the invention is smooth and does not interfere with the clubs use while also allowing the invention enough surface for a user to grip and install.

To facilitate ease of installation of the device 10 onto a golf club 26, the helical thread 22 may include a pointed end 40. The pointed end 40 is designed to pierce the proximal end 36 of the grip 24. The helical thread 22 may also include a thread-cutting screw type, such as a cutting slot 42. The cutting slot 42 helps to cut out the female side threads from the proximal end of the grip 24 such that the helical threads 22 of the device 10 can better engage the grip 24.

Figure 10:
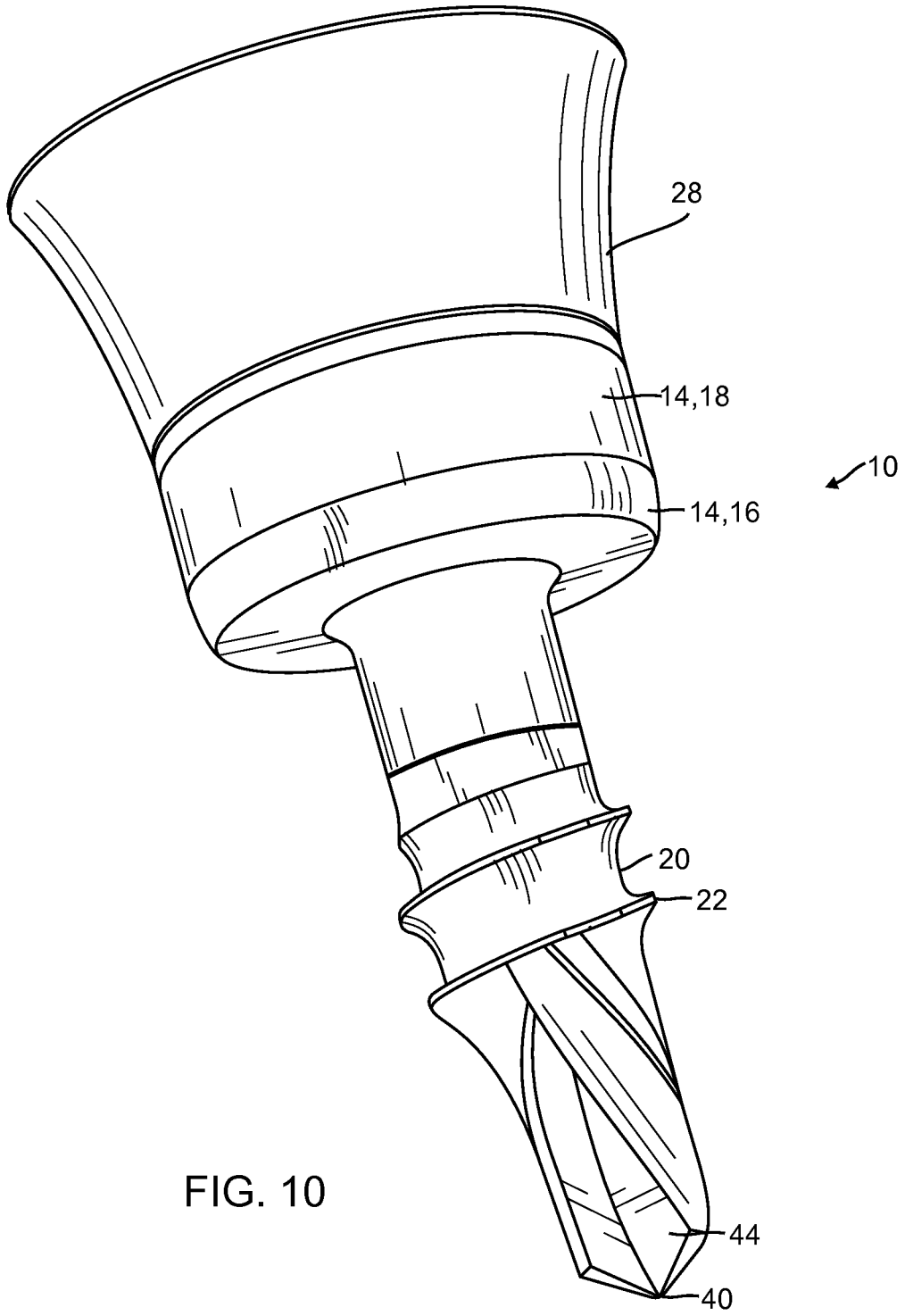
FIG. 10 is a perspective view of another exemplary retrieval device for golf clubs and golf balls embodying the present invention.

FIG. 10 is a perspective view of another exemplary retrieval device for golf clubs and golf balls 10 embodying the present invention. In this embodiment, the helical thread 22 may comprise a self-drilling thread type. The self-drilling thread type may include a drill distal end 44. The drill end 44 can penetrate much easier into the proximal end 36 of the grip 24 as compared to a blunt distal end of a screw 20. As can be seen by one skilled in the art, a variety of fastening features may be used to help screw the device 10 onto a grip 24 of a golf club 26, and this disclosure is not intended to limit it to just the precise forms disclosed herein.

Figure 8:
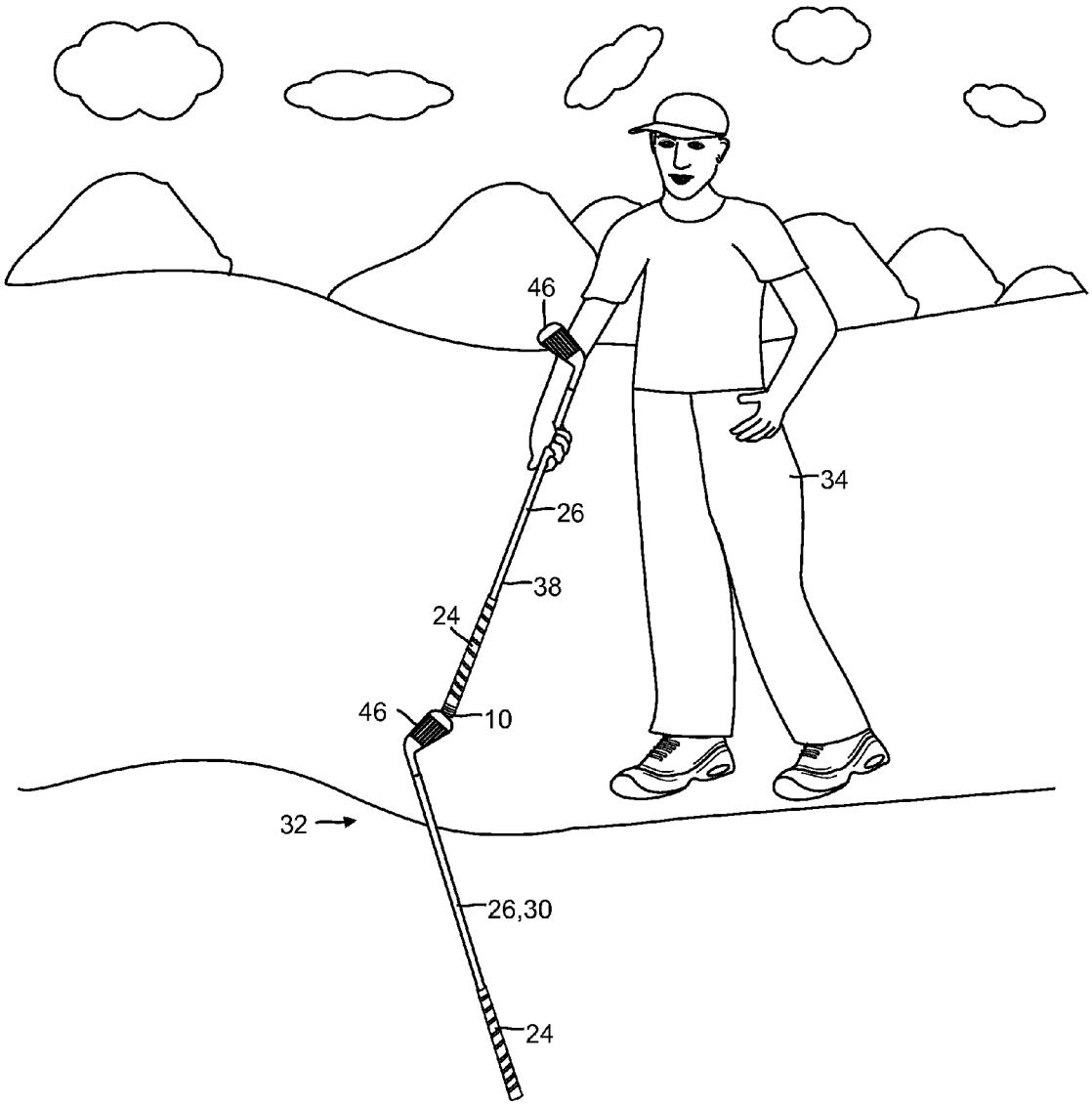
FIG. 8 is a perspective view of the structure of FIG. 5, illustrating how a golfer can pick up a club without bending over.

FIG. 8 is a perspective view of the structure of FIG. 7, illustrating how a golfer 34 can pick up a laying golf club 30 without bending over. A laying golf club 30 rests upon the playing surface 32. The method of picking up the laying golf club 30 includes attaching the retrieval device for golf clubs and golf balls 10 to the proximal end 36 of the grip 24 of a golf club 26. The device 10 includes the magnet 12 fixed relative to a helical thread 22, where the device 10 is screwed onto the proximal end 36 of the grip 24 of the golf club 26. The method includes grabbing a club head end 46 of the golf club 26 and lowering the grip 24 and attached device 10 close to the laying golf club 30. This then allows the magnet 12 to attract the laying golf club 30. The method then includes picking up the laying golf club 30 without the need for a golfer 34 to bend over or bend down to retrieve the laying golf club 30.

Figure 9:
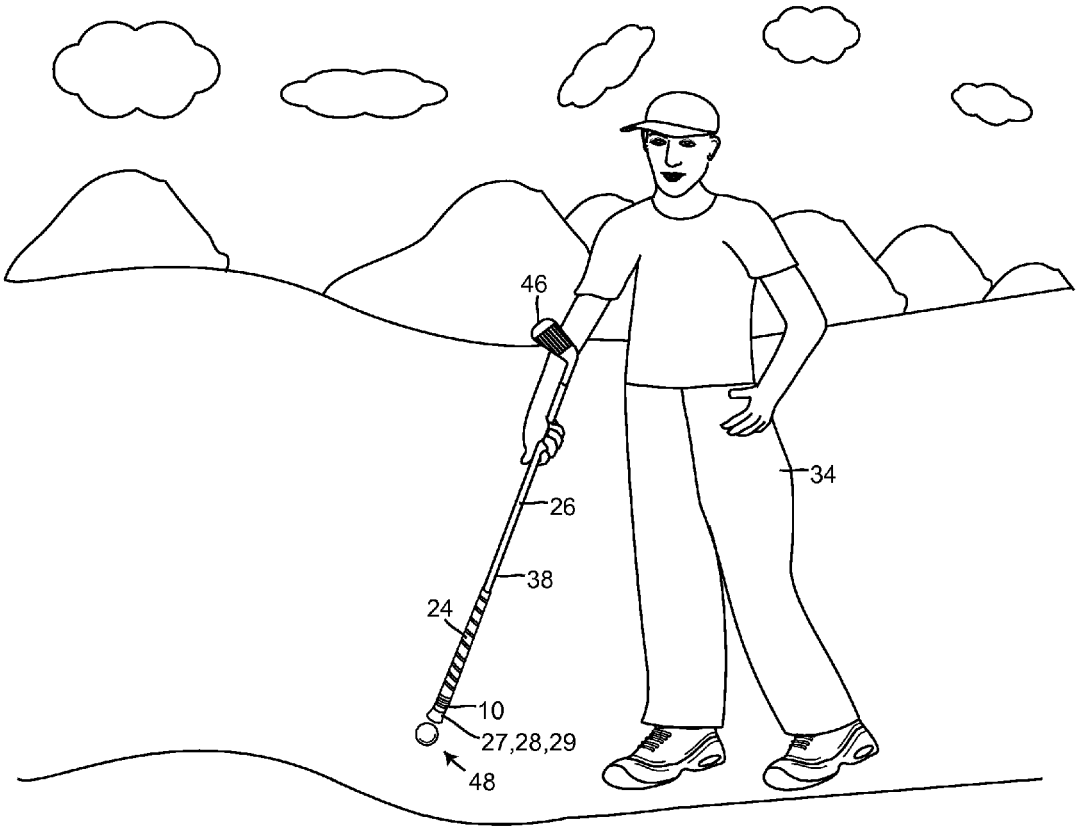
FIG. 9 is a perspective view of the structure of FIG. 5, illustrating how a golfer can pick up a ball without bending over.

FIG. 9 is a perspective view of the structure of FIG. 7, illustrating how a golfer 34 can pick up a laying golf ball 48 without bending over. A golf ball 48 rests upon the playing surface 32. The golfer 34 picks up the golf ball 48 by pressing the distal end of the device 10 over the golf ball as it lies on the floor. The golf ball retrieval implement (27, 28, or 29) attached the golf ball 48 to the device 10 through one of the systems described hereinabove. The golfer 24 is thereby able to lift the ball, using his club 26, without the need to bend over.

The device 10 may also include a re-attachable ball retrieval implement (28, or 29) wherein the ball retrieval implement may be removed and re-attached to the body 14. Various methods known the art, such as threads, hook-and-loop fasteners or friction snaps, may be used to removably attach the ball retrieval implement (28, or 29) to the body 14.

Figure 11:
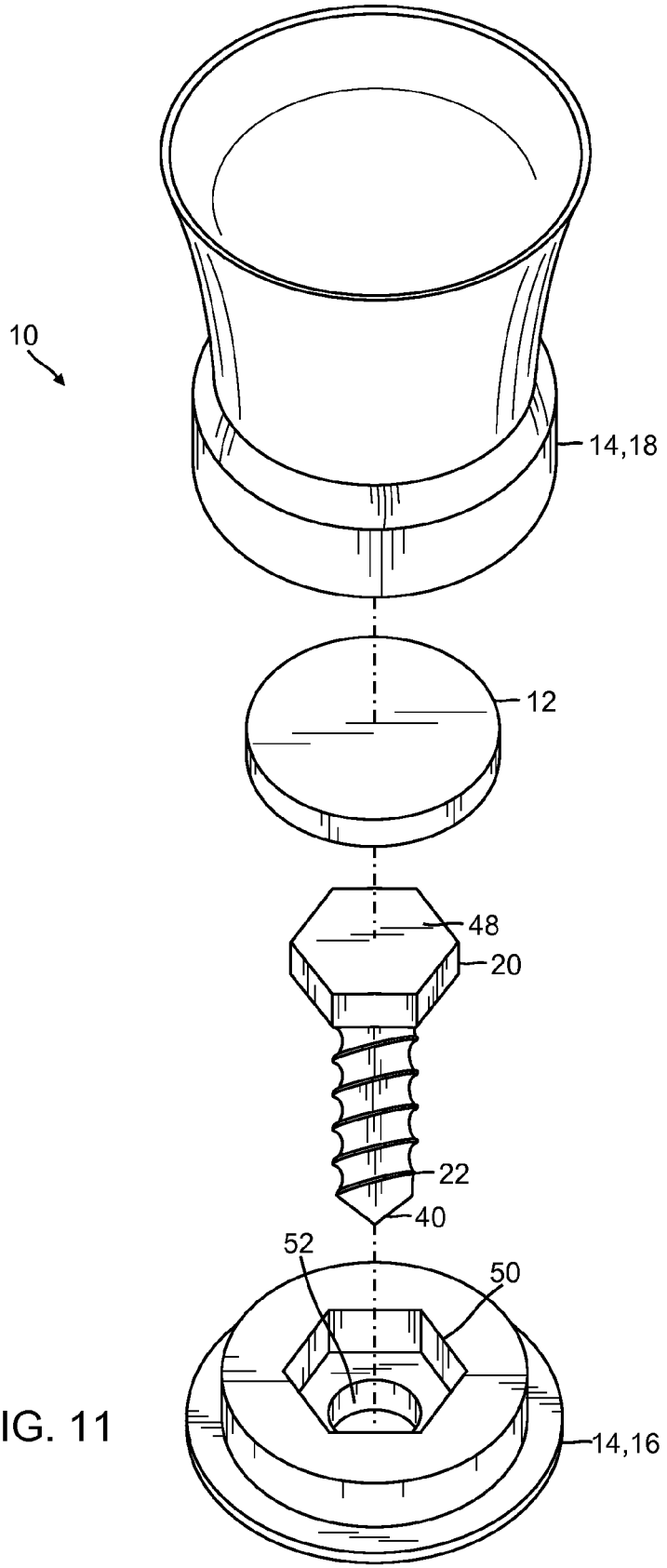
FIG. 11 is an exploded perspective view of another exemplary retrieval device for golf clubs and golf balls embodying the present invention.
Figure 12:
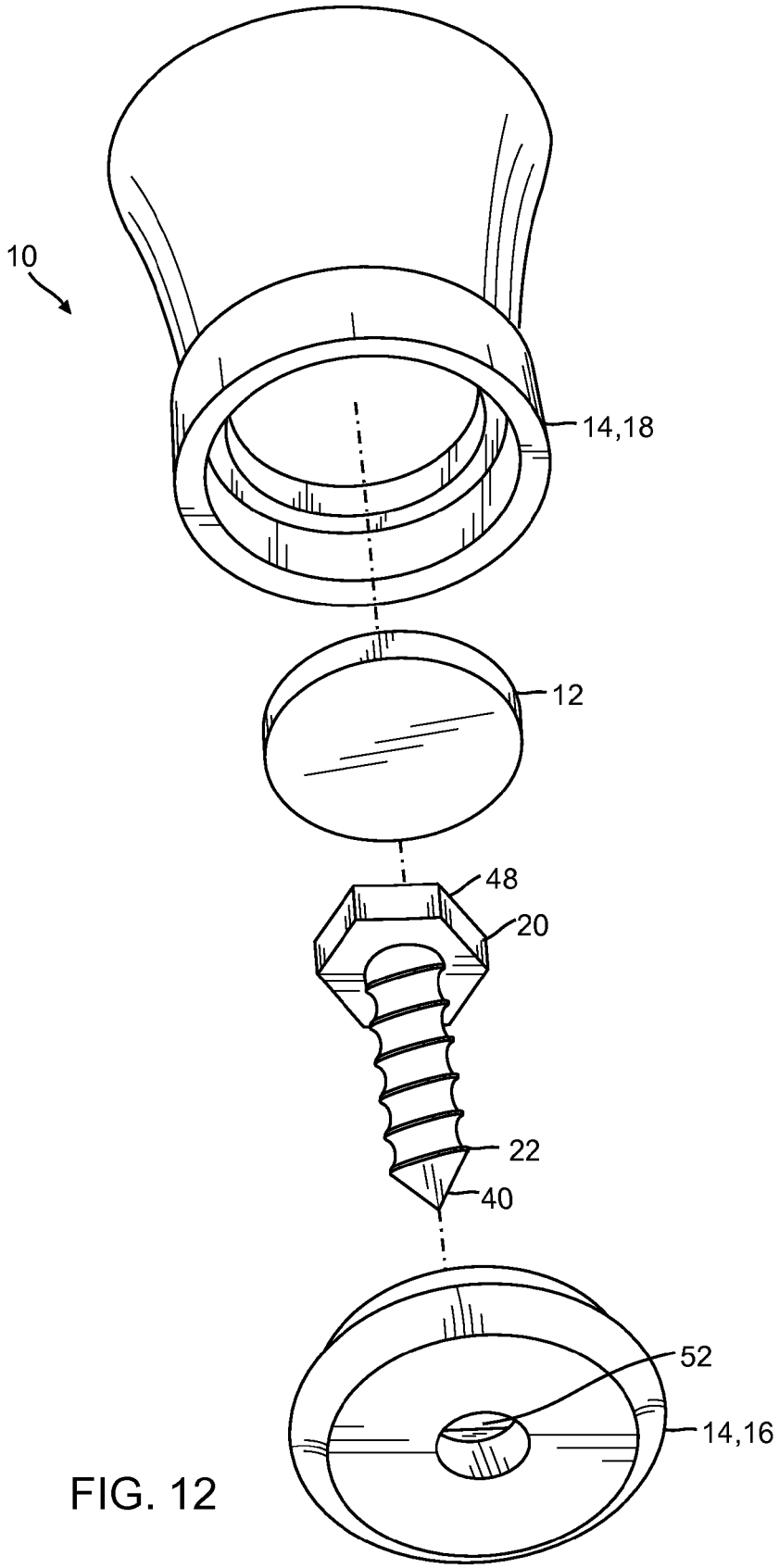
FIG. 12 is another exploded perspective view of the embodiment of FIG. 8.

FIG. 11 is an exploded perspective view of another exemplary retrieval device for golf clubs and golf balls 10 embodying the present invention and FIG. 12 is another exploded perspective view of the embodiment of FIG. 11. In this exemplary embodiment, a retrieval device for golf clubs and golf balls 10 utilizes a standard screw 20 in its assembly. The screw 20 has a hex head 48. The base 16 is configured to securely accept the hex head 48. The base 16 includes a hex-shaped recess 50 and an aperture 52. The hex head 48 of the screw 20 fits perfectly within the hex-shaped recess 50 of the base 16. This then secures the screw 20 relative to the base 16. The magnet 12 also is captured within the top 18. When the top 18, magnet 12, screw 20 and base 16 are bonded together, all the individual parts act as one unit. Then, a golfer 34 can grasp the device 10 and screw it into the proximal end 36 of a grip 24 of a golf club 26. To help a golfer 34 grasp the device 10, the top 18 may be made of a slip-resistant rubber or a comparable material.

Although several embodiments have been described in detail for purposes of illustration, various modifications may be made to each without departing from the scope and spirit of the invention. Accordingly, the invention is not to be limited, except as by the appended claims.

What is claimed is:

1. A retrieval device for golf clubs and golf balls removably attachable to a grip of a golf club without the need of a tool, comprising:

a magnet disposed within a body;

a ball retrieval implement attached to the body; and a helical thread fixed relative to the magnet and the body in non-movable relation, where the helical thread is configured to be screwed directly onto a proximal end of the grip of the golf club without the need of the tool, wherein the golf club can be used by a golfer to retrieve a laying golf club or a ball already on a playing surface without the need for the golfer to bend over or bend down; and wherein the ball retrieval implement is removably attached to the body while the magnet remains attached to the body; and wherein the body and the ball retrieval implement together comprise an outer cylindrical surface.

2. The device of claim 1, wherein this outer cylindrical surface is at least a half inch in height.

3. The device of claim 1, wherein the helical thread comprises a cutting slot for cutting threads when the device is screwed onto the proximal end of the grip of the golf club.

4. The device of claim 1, wherein the helical thread comprises a thread-cutting screw type, a self-drilling thread type, or a drill distal end.

5. The device of claim 1, wherein the magnet comprises a rare earth magnet.

6. The device of claim 1, wherein the body comprises an elastomeric material.

7. The device of claim 1, including wherein the ball retrieval implement comprises a suction-based ball retrieval implement.

8. The device of claim 1, wherein the ball retrieval implement comprises a friction-based ball retrieval implement.

9. The device of claim 1, wherein the ball retrieval implement comprises an adhesive-based ball retrieval implement.

10. The device of claim 1, wherein the body comprises a base and a top, the base and top cooperatively configured to retain the magnet within.

11. The device of claim 10, wherein the helical thread is permanently attached to the base.

12. A retrieval device for golf clubs and golf balls removably attachable to a grip of a golf club without the need of a tool, comprising:

a magnet disposed within a body, the body comprising a hex-shaped recess joined to an aperture;

a ball retrieval implement attached to the magnet or the body, where the body and the ball retrieval implement together comprise a continuous outer cylindrical surface at least a half inch in height and configured to be substantially the same diameter as the grip of the golf club; and a helical thread fixed relative to the magnet and the body in non-movable relation, where the helical thread comprises a screw with a hex head where the hex-shaped recess cooperatively receives the hex head of the screw and the helical thread of the screw protrudes through the aperture, and where the helical thread is configured to be screwed directly onto a proximal end of the grip of the golf club without the need of the tool, wherein the golf club can be used by a golfer to retrieve a laying golf club or ball already on a playing surface without the need for the golfer to bend over or bend down.

13. The device of claim 12, including wherein the ball retrieval implement comprises a suction-based ball retrieval implement.

14. The device of claim 12, wherein the ball retrieval implement comprises a friction-based ball retrieval implement.

15. The device of claim 12, wherein the ball retrieval implement comprises an adhesive-based ball retrieval implement.

16. The device of claim 12, wherein the ball retrieval implement is removably attached to the body.

17. The device of claim 12, wherein the ball retrieval implement is non-removably attached to the body.

18. A retrieval device for golf clubs and golf balls removably attachable to a grip of a golf club without the need of a tool, comprising:

a magnet disposed within a body;

a ball retrieval implement attached to the body; and a helical thread fixed relative to the magnet and the body in non-movable relation, where the helical thread is configured to be screwed directly onto a proximal end of the grip of the golf club without the need of the tool, wherein the golf club can be used by a golfer to retrieve a laying golf club or a ball already on a playing surface without the need for the golfer to bend over or bend down; and wherein the ball retrieval implement is removably attached to the body while the magnet remains attached to the body; and wherein the ball retrieval implement comprises a suction-based ball retrieval implement.

19. A retrieval device for golf clubs and golf balls removably attachable to a grip of a golf club without the need of a tool, comprising:

a magnet disposed within a body;

a ball retrieval implement attached to the body; and a helical thread fixed relative to the magnet and the body in non-movable relation, where the helical thread is configured to be screwed directly onto a proximal end of the grip of the golf club without the need of the tool, wherein the golf club can be used by a golfer to retrieve a laying golf club or a ball already on a playing surface without the need for the golfer to bend over or bend down; and wherein the ball retrieval implement is removably attached to the body while the magnet remains attached to the body; and wherein the ball retrieval implement comprises an adhesive-based ball retrieval implement.

* * * * *